US005550531A

United States Patent [19]

Little-Lowry

[11] Patent Number: 5,550,531

[45] Date of Patent: Aug. 27, 1996

[54] MOTORIZED BOAT-MOUNTED SIGNALING DEVICE FOR WATER SKIERS

[76] Inventor: Cheryl G. Little-Lowry, 70 Hawaii Dr., Aliso Viejo, Calif. 92656

[21] Appl. No.: 189,870

[22] Filed: Feb. 1, 1994

[51] Int. Cl.[6] ..... G08B 23/00

[52] U.S. Cl. ..... 340/573; 116/173; 116/303; 116/313; 340/691

[58] Field of Search ..... 340/573, 691, 340/815.83, 815.86, 815.87, 815.89, 686; 318/264–267, 283, 286; 116/26, 28 R, 173, 303, 313

[56] References Cited

U.S. PATENT DOCUMENTS 3,996,882 12/1976 Martin et al. ..... 116/173 X
4,782,784 11/1988 Little ..... 116/303
5,038,136 8/1991 Watson ..... 340/480
5,408,221 4/1995 Carsella, Sr. et al. ..... 340/573 X

*Primary Examiner*—Thomas Mullen
*Attorney, Agent, or Firm*—John J. Posta, Jr.

[57] ABSTRACT

A signaling device for raising a warning flag or pennant deployed on a motor boat to indicate that a water skier towed by the boat has fallen is disclosed which reliably raises a flag either manually when triggered by the motor boat operator or passenger, or automatically when the tow rope is released, thereby indicating to other boats in the vicinity that the water skier has fallen into the water. The heart of the device is a gear motor assembly operated by a DC motor, which is used to drive a flag pole containing a flag between lowered and deployed positions. Movement of the gear motor assembly is limited to ninety degrees by two micro switches, which remove power to the motor when an extreme position is reached.

14 Claims, 3 Drawing Sheets

MOTORIZED BOAT-MOUNTED SIGNALING DEVICE FOR WATER SKIERS

BACKGROUND OF THE INVENTION

Field of the Invention

The present invention relates generally to a device for raising a warning flag or pennant deployed on a motor boat to indicate that a water skier towed by the boat has fallen, and more particularly to a motorized electrical device for reliably raising a flag either manually when triggered by the motor boat operator or passenger, or automatically when the tow rope is released, indicating that the water skier has fallen into the water.

With the ever-increasing popularity of water sports, the number of water skiers has steadily increased, bringing ever larger numbers of water skiers and ski boats to a relatively fixed number of water recreation areas. While water skiers are sufficiently visible while skiing to prevent all but the most careless of boating accidents, the sport presents one extremely dangerous situation—namely that of the downed water skier.

It will be recognized that even the most skilled of water skiers will occasionally fall, and that most water skiers in recreational areas have a level of skill in the sport which is far less than highly skilled. This, of course, means that each ski boat is likely to have relatively frequent incidents in which the skier being towed from the boat is down in the water. The relatively great speed of motor boats and the relatively poor visibility of a downed water skier in the water makes spotting a downed water skier a difficult task requiring both concentration and a high degree of care.

In most instances the only visible indication of the presence of a downed water skier is a bobbing head in the water. In addition, in at least in some instances, the water skier may be briefly under the water, making the water skier even more difficult to spot. A downed water skier struck by a boat will likely be struck in the head, since it is the waters skier's head which is presented to the boat due to its location on the surface of the water. As such, a water skier in the water represents a potential fatality if struck by a boat, due to the speed and force with which a boat is likely to strike the water skier.

A common precaution in the sport is the use of an observer seated in the stern of the ski boat. The observer may quickly signal the driver when the water skier falls, and direct the driver to stop and return to the site where the water skier is floating. In fact, in many local jurisdictions, the presence of an observer is required by law. While the presence of an observer will ensure that the ski boat returns promptly to the site of a downed water skier, such an observer is not of great utility in warning other boats in the area that the water skier is down.

The observer may attempt to wave off boats approaching the site of the downed water skier, but it is unlikely that the observer will be heard or understood by operators of other boats due to the normal noise level of motor boats. The observer may even inadvertently act as a distraction to operators of other boats, thereby in fact increasing the likelihood that the operators of other boats will not see the downed water skier.

One early attempt to present a warning to other boats in the area involved attaching a warning device to the water skier, to thereby give the water skier greater visibility when down in the water. Unfortunately, the only way such a device could be readily visible was if it was attached to the water skier's head. Needless to say, relatively few water skiers care to damage their image by wearing cumbersome and unsightly paraphernalia on their heads. This strategy has therefore proved undesirable, and has never achieved great usage.

The signaling device that has shown the most promise is the warning flag or pennant, which is raised manually or otherwise when the water skier falls in order to warn operators of other boats that a downed water skier is in the vicinity. In fact, in areas under its jurisdiction, the United States Coast Guard has required that ski boats display a warning flag indicating the presence of a water skier in the water following a fall or other incident.

As with any rule of its type, adherence to this rule is directly proportional to the convenience of complying. If a flag is aboard, and if it is convenient to do so, the observer or operator may display the flag. Otherwise, no warning signal is given to protect the water skier down in the water.

As might be expected, a better potential solution to the problem was shortly forthcoming in the form of devices which were more convenient, or at least somewhat automatic in the deployment of a warning flag from a ski boat when the water skier was down in the water. By way of example, the former is illustrated in U.S. Pat. No. 3,786,778, to Palmer et al., and in U.S. Pat. No. 4,122,796, to Pressler et al., which both teach devices in which a flag and a flag pole are permanently mounted onto a ski boat at a location near the operator's position.

The flag pole in these devices is movable between two locking positions, one an undeployed or horizontal position, and the other a deployed or upright position. These devices are a step in the right direction since they ensure that a flag is conveniently located near the operator. However, with each of these devices, if the operator forgets to raise the flag, or deliberately does not raise it, there will be no warning flag displayed.

The other potential solution is even more desirable, in that devices which fall into the category designed to automatically raise a warning flag when the water skier is down in the water will be inherently more likely to ensure that a warning flag is deployed to indicate that the water skier is down in the water. These devices have been for the most part entirely mechanical in nature, and typically have a spring means which acts to urge the flag into an upright position. The flag is retained in a downward position by the tension of the ski rope, and when a water skier falls and drops the rope, the flag is raised.

One example of such a device is found in U.S. Pat. No. 3,602,188, to Penaflor, which describes a flag which pops up out of an essentially vertical cylinder when the tension on a tow rope is released. The Penaflor device also has an optional warning light on the driver's panel. A second example is shown in U.S. Pat. No. 3,735,724, to Miller et al., which teaches a flag mounted on a flag pole which swings from a horizontal position to a vertical position when the tension on the tow rope is released.

A third example is illustrated in U.S. Pat. No. 3,848,244, to Young et al., which uses the release of tension on the tow rope to free a spring-loaded flag. A fourth example is found in U.S. Pat. No. 3,798,631, to Langford, which uses the release of tension on the tow rope to signal an alarm which sounds until a flag is raised, either manually by the operator, or automatically by the system. Yet another example is found in U.S. Pat. No. 4,545,320, to Lewis et al. which shows both a manual flag and an automatic flag similar to the Miller et al. device mentioned above.

Such devices have several problems inherent in their designs. First, if the water skier is caught on the tow rope, the flag will not deploy, even though the skier in completely in the water. In some circumstances, even though the water skier has released the tow rope, the drag of the rope in the water may prevent the flag from being deployed, especially as the device gets older and exhibits some degree of wear.

If multiple water skiers are being towed behind a single boat, either only one of the tow ropes will operate the flag, or the flag will not be operated until all of the skiers are simultaneously down in the water. Finally, it is apparent that in devices relying on tension in the tow rope to keep the flag down, the flag will be fully deployed when the skier is getting ready to be towed, or even when the boat is not being used for water skiing. The flag would have to be fastened down by rope or the like to keep it out of the deployed position.

An important note to make regarding the performance of all of these somewhat automatic devices is that the operator of the boat, or the observer in the boat, can not manually cause the flag to be raised. Only the fully manual systems allow the operator or the observer to raise the flag at all. Thus, all of the devices described above except for the fully manual devices will only operate to raise the flag when all of the tension is removed from the tow rope.

A substantially improved signaling device was taught in U.S. Pat. No. 4,782,784, to Little, the inventor of the present invention. It should be noted that the present invention represents an improvement to device illustrated in the Little patent.

It is accordingly the primary objective of the signaling device of the present invention that it be capable of operating positively and dependably without requiring as a basis for operation the existence of a lack of tension in the tow rope. As such, it is a related objective that the signaling device of the present invention should desirably be capable of operation quickly and automatically when a skier falls, yet in a manner not precluding manual actuation by the operator of the ski boat or by an observer in the boat. The signaling device of the present invention thus should include apparatus allowing for manual actuation of the device by the operator of the boat or by an observer in the boat in emergency situations, in addition to its automatic actuation capability.

It is also an objective that the signaling device of the present invention be usable with a boat towing a plurality of water skiers, and as such it must be operable to automatically raise the flag when any one of the water skiers is down in the water. It is yet another objective that the mechanism used by the signaling device of the present invention to raise the flag be highly compact in size, unlike past purely mechanical designs, while presenting a character of operation which is better than such past mechanical designs. In addition, it is a further objective of the present invention that the signaling device be installable on any boat in an easy and expeditious manner, and that it be installable onto a boat without requiring the assistance of a professional.

The signaling device of the present invention must also be of construction which is both durable and long lasting, and it should additionally require little or no maintenance to be provided by the user throughout its operating lifetime. In order to enhance the market appeal of the signaling device of the present invention, it should also be of inexpensive construction to thereby afford it the broadest possible market. Finally, it is also an objective that all of the aforesaid advantages and objectives of the signaling device of the present invention be achieved without incurring any substantial relative disadvantage.

SUMMARY OF THE INVENTION

The disadvantages and limitations of the background art discussed above are overcome by the present invention. With this invention, the mechanical designs of the prior art, and even the electromechanical device represented by the Little device mentioned above, are surpassed both in operational capability, as well as in sophistication of packaging the improved device into a small, yet effective and durable, package.

In its preferred embodiment, the signaling device of the present invention has three essential components, which are operated electrically using electrical power supplied by the electrical system of the boat onto which the signaling device of the present invention is installed. The first two components are switches, one located in the handle of the water ski tow rope, and the second located in the boat for actuation by the operator of the boat or by an observer in the boat. Either of these two switches are capable of initiating a signal to cause the third component to deploy a flag into an upright position.

It is this third component which is the heart of the present invention; this third component is operationally elegant, and yet it is simple both in its operation and in its assembly. It consists of an electrically operated DC motor having attached thereto a housing containing a gear reducer, so that when the DC motor operates it rotates an output shaft at a relatively slower speed than the operating speed of the DC motor. A flag pole is fixedly attached at its proximal end to one end of the output shaft to rotate therewith, and the flag pole has a flag located at its distal end.

Also fixedly attached to the output shaft to rotate therewith is an eccentrically mounted switch reverse block. Two micro switches are fixedly located with respect to the gear reducer housing for actuation by the switch reverse block. The micro switches are used to interrupt the supply of electrical power to the DC motor when the output shaft has rotated approximately ninety degrees. By reversing the polarity of electrical power supplied to the DC motor, the direction of rotation of the output shaft can be reversed. Thus, operation of the DC motor will only be capable of driving the output shaft between two angular positions which are approximately ninety degrees apart.

The DC motor, the gear reducer housing, the switch reverse block, and the two micro switches are all located inside an enclosure, with one end of the output shaft extending therefrom. It is this end of the output shaft on which the flag pole is mounted. In the preferred embodiment, the flag pole is mounted to the output shaft with a flag holding block which allows for the length of the flag pole to be varied, or for the flag pole to be completely removed for storage.

The switch used in the handle of the water ski tow rope is a normally open switch. When a water skier falls and drops the handle of the tow rope, the switch in the handle closes, causing electrical power to be supplied to the DC motor in a polarity which will drive the flag into the deployed (upright) position. Similarly, a second normally open switch is located in the boat for operation by the operator of the boat or by an observer in the boat. Operation of this second switch to close it also causes electrical power to be supplied to the DC motor in a polarity which will drive the flag into the deployed (upright) position.

Also located in the boat for operation by the operator of the boat or by an observer in the boat is a reset switch, which is also normally open. Operation of the reset switch to close it will cause electrical power to be supplied to the DC motor in a polarity which will drive the flag into the undeployed (horizontal) position. Operation of the reset switch simultaneously with the deployment operating switch in the boat is prevented by a mechanical interlock. Preferably, these two switches consist of a single double-pole, double-throw (DPDT) on-off-on switch, which, due to its inherent nature, will act as a positive interlock.

It may therefore be seen that the present invention teaches a signaling device which is capable of operating positively and dependably without requiring as a basis for its operation the existence of a lack of tension in the tow rope. As such, the signaling device of the present invention is entirely capable of operation to deploy a flag quickly and automatically when a skier falls, yet in a manner which does not preclude manual actuation by the operator of the ski boat or by an observer in the boat. The signaling device of the present invention thus includes apparatus allowing for manual actuation of the device by the operator of the boat or by an observer in the boat to deploy the flag in emergency situations, in addition to its automatic actuation capability.

The signaling device of the present invention is usable with a boat towing a plurality of water skiers, and is operable to automatically raise the flag when any one of the water skiers is down in the water. The mechanism used by the signaling device of the present invention to raise the flag is highly compact in size, unlike past purely mechanical designs, while presenting a character of operation which is better than such past mechanical designs. In addition, the signaling device of the present invention is capable of installation on any boat in an easy and expeditious manner, without requiring the assistance of a professional.

The signaling device of the present invention is also of a construction which is both durable and long lasting, and it thus requires little or no maintenance to be provided by the user throughout its operating lifetime. In order to enhance the market appeal of the signaling device of the present invention, it is of inexpensive construction. Finally, all of the aforesaid advantages and objectives of the signaling device of the present invention are achieved without incurring any substantial relative disadvantage.

DESCRIPTION OF THE DRAWINGS

These and other advantages of the present invention are best understood with reference to the drawings, in which:

FIG. 8 is a side view of an enclosure open on one side thereof from the side opposite the open side of the enclosure, showing a large aperture through which one end of the output shaft of the gear motor illustrated in FIG. 3 extends, and also showing bolts which are used to mount the gear motor assembly illustrated in FIGS. 1 through 3 inside the enclosure;

DETAILED DESCRIPTION OF THE PREFERRED EMBODIMENT

Figure 1:
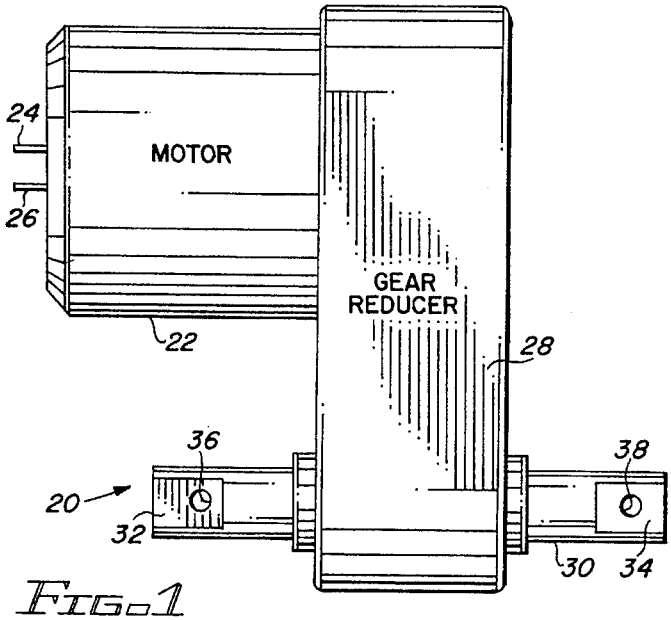
FIG. 1 is a top plan view of a gear motor assembly, which includes a DC motor mounted onto one side of a gear reducer, with the DC motor operating the gear reducer to drive an output shaft having both ends extending from opposite sides of the gear reducer.
Figure 2:
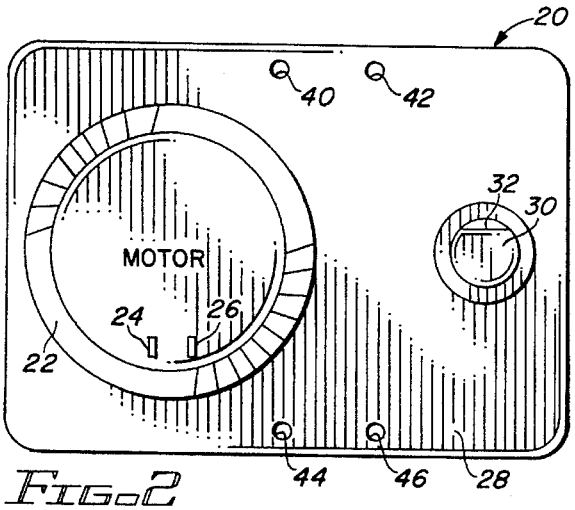
FIG. 2 is a side view of the gear motor assembly illustrated in FIG. 1 from the side on which the DC motor is mounted, showing threaded apertures which will be used to mount a bracket onto the gear motor assembly (not shown in FIG. 2)
Figure 3:
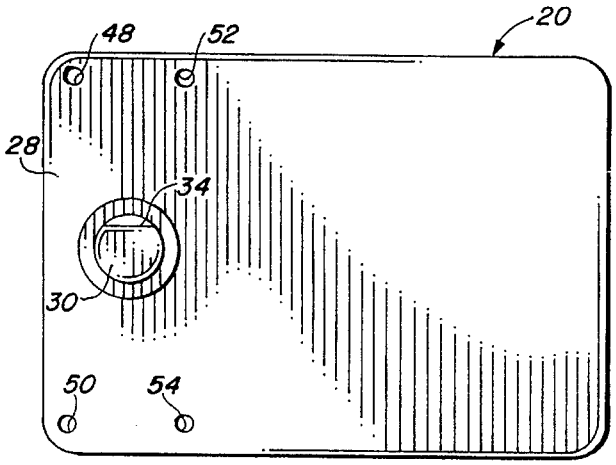
FIG. 3 is a side view of the gear motor assembly illustrated in FIGS. 1 and 2 from the side away from the DC motor, showing threaded apertures which will be used to mount the gear motor assembly within an enclosure (not shown in FIG. 3)

The preferred embodiment of the signaling device of the present invention replaces the complex mechanical mechanisms used to deploy flags in the past with an electrically operated deployment device. The heart of this device is a gear motor assembly 20, which is illustrated in FIGS. 1 through 3. The gear motor assembly 20 is driven by a small DC motor 22, which is supplied with electrical power by a pair of wires 24 and 26.

The DC motor 22 is fixedly mounted onto one side of a gear reducer 28, with the shaft (not shown) of the DC motor 22 being operatively connected to drive the gear reducer 28. The gear reducer 28 has an output shaft 30 extending from both sides of the gear reducer 28 (i.e., the side of the gear reducer 28 on which the DC motor 22 is mounted, and the side of the gear reducer 28 facing away from the DC motor 22).

Connection of the wires 24 and 26 to a DC power source in a first polarity will cause the DC motor 22 to drive the gear reducer 28 to cause the output shaft 30 to rotate in a first direction. Similarly, connection of the wires 24 and 26 to a DC power source in a second polarity opposite to the first polarity will cause the DC motor 22 to drive the gear reducer 28 to cause the output shaft 30 to rotate in a second direction opposite to the first direction. The gear reducer 28 causes the output shaft 30 to rotate at a much slower speed than the speed of rotation of the DC motor 22.

The output shaft 30 has a flat face 32 located on the end of the output shaft 30 extending from the side of the gear reducer 28 on which the DC motor 22 is mounted. The output shaft 30 also has a flat face 34 located on the end of the output shaft 30 extending from the side of the gear reducer 28 facing away from the DC motor 22. The flat face 32 of the output shaft 30 and the flat face 34 of the output shaft 30 both have the same orientation, as best illustrated in FIG. 1.

Extending orthogonally through both the output shaft 30 and the flat face 32 of the output shaft 30 is an aperture 36. Similarly, extending orthogonally through both the output shaft 30 and the flat face 34 of the output shaft 30 is an aperture 38. The apertures 36 and 38 will be used to retain other components (not yet shown and to be discussed below) on the respective ends of the output shaft 30.

Each side of the gear reducer 28 has four threaded apertures located therein. Referring first to FIG. 2, it may be seen that the side of the gear reducer 28 on which the DC motor 22 is mounted has two spaced-apart threaded apertures 40 and 42 located near the top edge thereof, between the parallel centerlines of the DC motor 22 and the output shaft 30. This side of the gear reducer 28 has two additional spaced-apart threaded apertures 44 and 46 located near the bottom edge thereof, again between the centerlines of the DC motor 22 and the output shaft 30. The threaded apertures 40 and 44 are relatively closer to the centerline of the DC motor 22 than to the centerline of the output shaft 30, while the threaded apertures 42 and 46 are relatively closer to the centerline of the output shaft 30 than to the centerline of the DC motor 22.

Referring now to FIG. 3, it may be seen that the side of the gear reducer 28 facing away from the DC motor 22 has two threaded apertures 48 and 50 located in the corners of the gear reducer 28 at the side of the gear reducer 28 adjacent to the output shaft 30 (and furthest from the DC motor 22). The threaded aperture 48 is located near the top edge of the gear reducer 28, while the threaded aperture 50 is located near the bottom of the gear reducer 28. An additional threaded aperture 52 is located near the top edge of the gear reducer 28 on the other side of the output shaft 30 from the threaded aperture 48. Similarly, an additional threaded aperture 54 is located near the bottom edge of the gear reducer 28 on the other side of the output shaft 30 from the threaded aperture 50.

Figure 4:
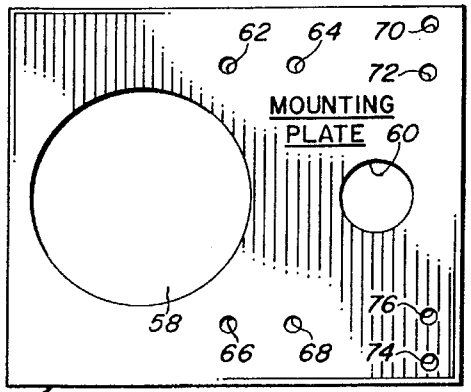
FIG. 4 is a plan view of a mounting plate which will be located on the side of the gear motor assembly illustrated in FIG. 2, showing apertures which will be used to mount the mounting plate onto the gear motor assembly and additional apertures which will be used to mount micro switches (not shown in FIG. 4)

Referring next to FIG. 4, a mounting plate 56 which will be located closely adjacent to the side of the gear motor assembly 20 illustrated in FIG. 2 (the side of the gear reducer 28 on which the DC motor 22 is mounted) is illustrated. The mounting plate 56 is flat, and of slightly larger size than the size of the side of the gear reducer 28. Located in the mounting plate 56 are two large apertures 58 and 60, which are sized to respectively admit the DC motor 22 (FIG. 2) and the output shaft 30 (FIG. 2). As such, the aperture 58 is slightly larger in diameter than the outer diameter of the DC motor 22, while the aperture 60 is quite a bit larger than the outer diameter of the output shaft 30.

Four countersunk apertures are located in the mounting plate 56, which correspond in respective location to the four threaded apertures 40, 42, 44, and 46 on the side of the gear reducer 28 illustrated in FIG. 2. Thus, two spaced-apart countersunk apertures 62 and 64 are located near the top edge of the mounting plate 56, between the parallel centerlines of the aperture 58 and the aperture 60. Two additional spaced-apart countersunk apertures 66 and 68 are located near the bottom edge of the mounting plate 56, again between the centerlines of the aperture 58 and the aperture 60. The countersunk apertures 62 and 66 are relatively closer to the centerline of the aperture 58 than to the centerline of the aperture 60, while the countersunk apertures 64 and 68 are relatively closer to the centerline of the aperture 58 than to the centerline of the aperture 60.

Also located in the mounting plate 56 are four threaded apertures, pairs of which will be used to mount micro switches (not yet shown and to be discussed below). The four threaded apertures extend in a line located both parallel to and close to the side edge of the mounting plate 56 adjacent to the aperture 60 (and furthest from the aperture 58). A threaded aperture 70 is located near the top edge of the mounting plate 56, while a threaded aperture 72 is spaced away from the threaded aperture 70 toward the bottom of the mounting plate 56. Similarly, a threaded aperture 74 is located near the bottom edge of the mounting plate 56, while a threaded aperture 76 is spaced away from the threaded aperture 74 toward the top of the mounting plate 56.

Figure 5:
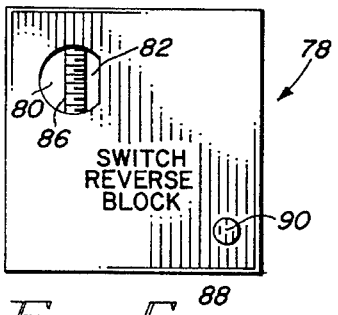
FIG. 5 is a plan view of a switch reverse block showing an aperture which will used to install the switch reverse block onto the end of the output shaft illustrated in FIG. 2.
Figure 6:
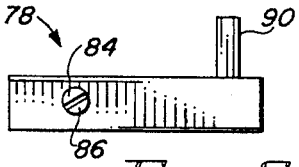
FIG. 6 is a side view of the switch reverse block illustrated in FIG. 5, showing a pin extending from one side of the switch reverse block, which pin will be used to actuate micro switches (not shown in FIG. 6)

Referring next to FIGS. 5 and 6, a switch reverse block 78 is illustrated; the switch reverse block 78 is essentially an eccentric element which will rotate with the end of the output shaft 30 extending from the side of the gear reducer 28 on which the DC motor 22 is mounted (FIG. 2) to operate a pair of micro switches (not yet shown and to be discussed below). The switch reverse block 78 is essentially flat, as best shown in FIG. 6. An irregular aperture 80 extends through the face of the switch reverse block 78 near the upper left corner in the view shown in FIG. 5.

This aperture 80 is sized and configured with a flat side 82 to closely fit over the end of the output shaft 30 having the flat face 32 thereon (FIG. 1). Extending within the switch reverse block 78 is a threaded aperture 84 as shown in FIG. 6, which threaded aperture 84 extends orthogonally through the irregular aperture 80. A slotted screw 86 may be threaded into the threaded aperture 84, as shown in FIGS. 5 and 6. When the irregular aperture 80 in the switch reverse block 78 is placed over the end of the output shaft 30 having the flat face 32 thereon, the slotted screw 86 will extend through the aperture 36 in the output shaft 30 to thereby retain the switch reverse block 78 in position on the output shaft 30.

Located in the lower right corner of the switch reverse block 78 as shown in FIG. 5 (the opposite corner from that in which the irregular aperture 80 is located) is an aperture 88, in which a pin 90 is fixedly mounted. As shown in FIG. 6, the pin 90 extends from the back side of the switch reverse block 78. The pin 90 will be used to actuate micro switches (not yet shown and to be discussed immediately below) as the switch reverse block 78 is rotated on the output shaft 30 (FIG. 2).

Figure 7:
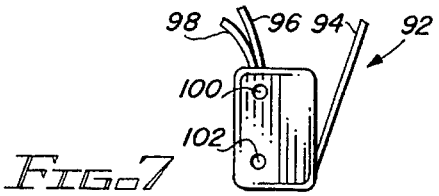
FIG. 7 is a plan view of a micro switch, two of which will be used in the device of the present invention, showing an arm which, when depressed, will actuate the micro switch from a closed position to an open position, and also showing two apertures located in the micro switch which will be used to mount the micro switch onto the mounting plate illustrated in FIG. 4.

Referring next to FIG. 7, a micro switch 92 is illustrated. The micro switch 92 has a switch arm 94 extending from one corner thereof, and two wires 96 and 98 extending therefrom. Located in the corners of the side of the micro switch 92 opposite to the side adjacent the switch arm 94 are two apertures 100 and 102, which will be used to mount the micro switch 92. When the switch arm 94 is in the position illustrated in FIG. 7, the micro switch 92 will be in the closed position. When the switch arm 94 is pressed and moves counter-clockwise according to the view shown in FIG. 7, the micro switch 92 will then be in the open position.

Since the gear motor assembly 20 of the present invention requires two micro switches 92, suffixes "A" and "B" will be used to describe them. Accordingly, micro switches 92A and 92B will be used herein. Corresponding parts of the micro switches 92A and 92B will also use the same suffixes.

Figure 9:
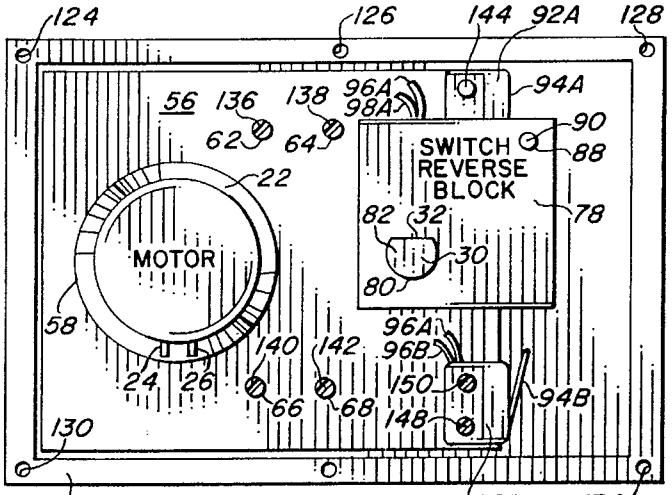
FIG. 9 is a side view into the open side of the enclosure illustrated in FIG. 8, showing the gear motor assembly illustrated in FIGS. 1 through 3, the mounting plate illustrated in FIG. 4, the switch reverse block illustrated in FIGS. 5 and 6, and two of the micro switches illustrated in FIG. 7 assembled into the enclosure, with the output shaft of the gear motor assembly being shown in the undeployed position.

Moving next to FIGS. 8 and 9, an enclosure 104 which is open on one side thereof is illustrated, with the various components described above being mounted into the enclosure 104. The view illustrated in FIG. 8 is of the side opposite the open side of the enclosure 104, while the view illustrated in FIG. 9 is into the open side of the enclosure 104.

Referring first to FIG. 8, an aperture 106 is located to the left of dead center and in the vertical center of the enclosure 104 (as illustrated in FIG. 8) in the side of the enclosure 104 opposite the open side of the enclosure 104 (which is shown in FIG. 9). This aperture 106 accommodates the end of the output shaft 30 having the flat face 34 located thereon (the end of the output shaft 30 extending from the side of the gear reducer 28 opposite the DC motor 22), which extends therethrough. The aperture 106 is quite a bit larger than the outer diameter of the output shaft 30, to thereby allow the output shaft 30 to rotate without binding in the aperture 106.

Four countersunk apertures are also located in the same side of the enclosure 104 as is the aperture 106, which countersunk apertures correspond in relative location to the four threaded apertures 48, 50, 52, and 54 on the side of the gear reducer 28 illustrated in FIG. 3. Thus, two countersunk apertures 108 and 110 are located to the left side of the aperture 106 as illustrated in FIG. 8, with the other two countersunk apertures 112 and 114 being located to the right side of the aperture 106. The countersunk apertures 108 and 112 are located just over three-quarters of the way up the side of the enclosure 104, while the countersunk apertures 110 and 114 are located just less than one-quarter of the way up the side of the enclosure 104.

In assembling the signaling device of the present invention together, the gear motor assembly 20 is placed inside the enclosure 104 with the end of the output shaft 30 having the flat face 34 thereon (the end of the output shaft 30 extending from the side of the gear reducer 28 opposite the DC motor 22) extending through the aperture 106 in the side of the enclosure 104. A flat-head bolt 116 is inserted into the countersunk aperture 108 in the enclosure 104, and then into the threaded aperture 48 in the gear reducer 28 (FIG. 3).

A flat-head bolt 118 is inserted into the countersunk aperture 110 in the enclosure 104, and then into the threaded aperture 50 in the gear reducer 28 (FIG. 3). A flat-head bolt 120 is inserted into the countersunk aperture 112 in the enclosure 104, and then into the threaded aperture 52 in the gear reducer 28 (FIG. 3). A flat-head bolt 122 is inserted into the countersunk aperture 114 in the enclosure 104, and then into the threaded aperture 54 in the gear reducer 28 (FIG. 3).

Referring next to FIG. 9, the open side of the enclosure 104 is illustrated. Note that there are six threaded apertures disposed about the perimeter of the open side of the enclosure 104. These threaded apertures will be used to install a cover (not yet shown and to be discussed below) over the open side of the enclosure 104.

As illustrated in FIG. 9, at the upper left corner of the enclosure 104 is a threaded aperture 124, at the top of the enclosure 104 in the center thereof is a threaded aperture 126, at the upper right corner of the enclosure 104 is a threaded aperture 128, at the lower left corner of the enclosure 104 is a threaded aperture 130, at the bottom of the enclosure 104 in the center thereof is a threaded aperture 132, and at the lower right corner of the enclosure 104 is a threaded aperture 134.

As mentioned above, the mounting plate 56 fits in place closely adjacent the side of the gear reducer 28 of the gear motor assembly 20 (FIG. 2), with the DC motor 22 extending through the aperture 58 in the mounting plate 56, and with the output shaft 30 extending through the aperture 60 (FIG. 4) of the mounting plate 56. Four flat-head bolts are used to retain the mounting plate 56 in place with respect to the gear motor assembly 20.

A flat-head bolt 136 is inserted into the countersunk aperture 62 in the mounting plate 56, and then into the threaded aperture 40 in the gear reducer 28 (FIG. 2). A flat-head bolt 138 is inserted into the countersunk aperture 64 in the mounting plate 56, and then into the threaded aperture 42 in the gear reducer 28 (FIG. 2). A flat-head bolt 140 is inserted into the countersunk aperture 66 in the mounting plate 56, and then into the threaded aperture 44 in the gear reducer 28 (FIG. 2). A flat-head bolt 142 is inserted into the countersunk aperture 68 in the mounting plate 56, and then into the threaded aperture 46 in the gear reducer 28 (FIG. 2).

Next, the micro switches 92A and 92B are installed. The micro switch 92A is installed using two round-head bolts. A round-head bolt 144 is inserted through the aperture 102A (FIG. 7) in the micro switch 92A, and then into the threaded aperture 70 (FIG. 4) in the mounting plate 56. A round-head bolt 146 (not shown) is inserted through the aperture 100A (FIG. 7) in the micro switch 92A, and then into the threaded aperture 72 (FIG. 4) in the mounting plate 56.

Similarly, the micro switch 92B is also installed using two round-head bolts. A round-head bolt 148 is inserted through the aperture 102B (FIG. 7) in the micro switch 92B, and then into the threaded aperture 74 (FIG. 4) in the mounting plate 56. A round-head bolt 150 is inserted through the aperture 100B (FIG. 7) in the micro switch 92B, and then into the threaded aperture 76 (FIG. 4) in the mounting plate 56.

Next, the switch reverse block 78 is mounted on the end of the output shaft 30 having the flat face 32 thereon (the end of the output shaft 30 on the same side of the gear reducer 28 as the DC motor 22). The end of the output shaft 30 having the flat face 32 thereon is inserted into the irregular aperture 80, with the flat face 32 of the output shaft 30 being aligned with the flat side 82 of the aperture 80. Note that the pin 90 will extend inwardly from the switch reverse block 78 into the enclosure 104, to thereby extend into the same plane as the switch arms 94A and 94B of the micro switches 92A and 92B, respectively. The slotted screw 86 (FIGS. 5 and 6) would then be screwed into the threaded aperture 84 in the switch reverse block 78, with the slotted screw 86 thereby passing through the aperture 36 (FIG. 1) in the output shaft 30.

Figure 10:
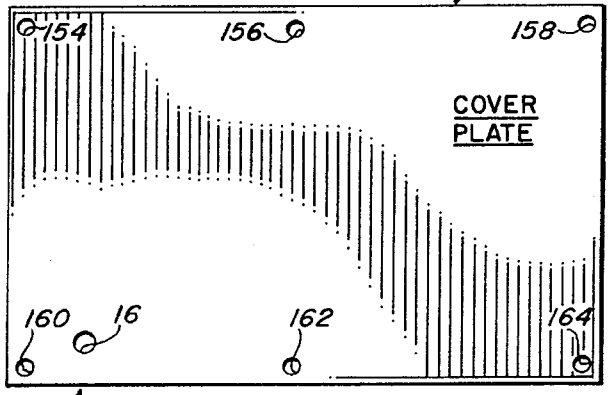
FIG. 10 is a plan view of a cover plate used to close the open side of the enclosure illustrated in FIGS. 8 and 9.
Figure 5:
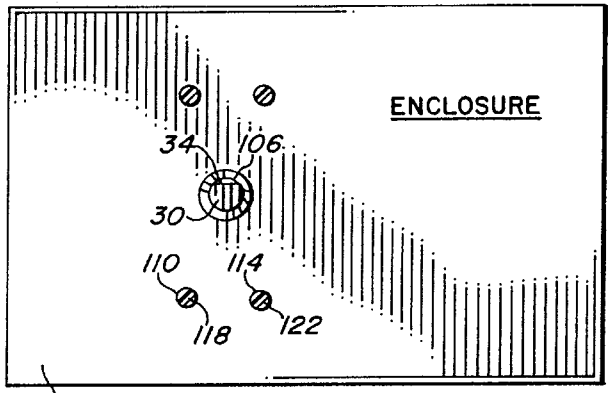

Referring next to FIG. 10, a cover plate 152 for closing the open side of the enclosure 104 illustrated in FIGS. 8 and 9 is illustrated. The cover plate 152 has six countersunk apertures located therein which countersunk apertures are disposed about the perimeter of the cover plate 152. These countersunk apertures correspond in respective location to the six threaded apertures 124, 126, 128, 130, 132, and 134 in the open side of the enclosure 104 (FIG. 9).

As illustrated in FIG. 10, at the upper left corner of the cover plate 152 is a countersunk aperture 154, at the top of the cover plate 152 in the center thereof is a countersunk aperture 156, at the upper right corner of the cover plate 152 is a countersunk aperture 158, at the lower left corner of the cover plate 152 is a countersunk aperture 160, at the bottom of the cover plate 152 in the center thereof is a countersunk aperture 162, and at the lower right corner of the cover plate 152 is a countersunk aperture 164. Completing the construction of the cover plate 152 is an aperture 165, which will be used to bring the various wires out of the enclosure 104 (FIG. 9).

Figure 12:
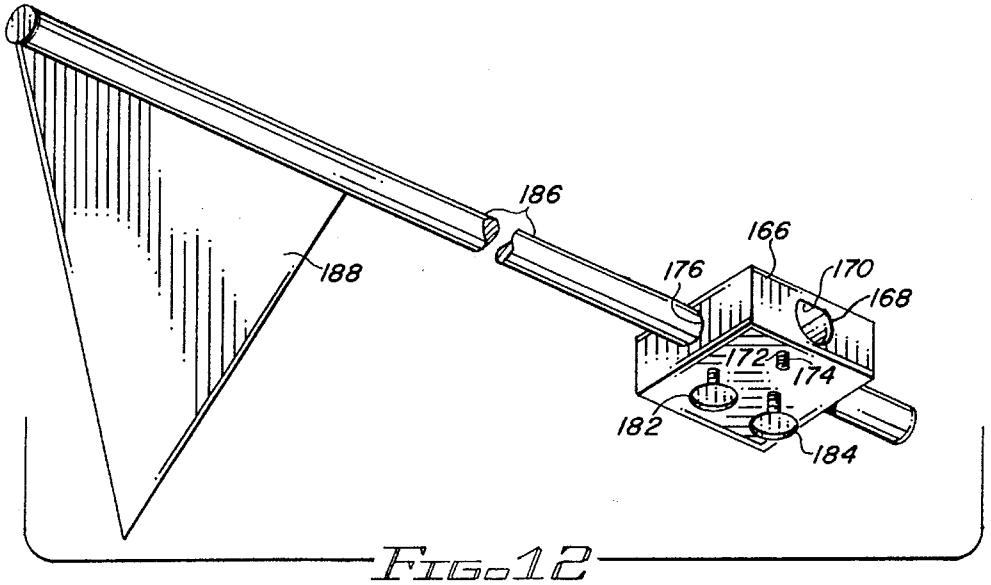
FIG. 12 is a perspective view of a flag holder block for mounting onto the end of the output shaft illustrated in FIG. 3 as it extends through the closed side of the enclosure illustrated in FIGS. 8 and 9, showing the proximal end of a flag pole being removably retained within the flag holder block, and also showing a flag mounted onto the distal end of the flag pole.

Referring now to FIG. 12, a flag holder block 166 for mounting onto the end of the output shaft 30 having the flat face 34 thereon (FIG. 3) is illustrated. The flag holder block 166 has an irregular aperture 168 located therein in one face of the flag holder block 166. This irregular aperture 168 is sized and configured with a flat side 170 to closely fit over the end of the output shaft 30 having the flat face 34 thereon (the end of the output shaft 30 extending from the side of the gear reducer 28 opposite the DC motor 22, and extending through the aperture 106 in the side of the enclosure 104 opposite the open side).

Extending within the flag holder block 166 is a threaded aperture 172, which threaded aperture 172 extends orthogonally through the irregular aperture 168. A slotted screw 174 may be threaded into the threaded aperture 172, as shown. The irregular aperture 168 in the flag holder block 166 is placed over the end of the output shaft 30 having the flat face 34 thereon, with the slotted screw 174 extending through the aperture 38 in the output shaft 30 to thereby retain the flag holder block 166 in position on the output shaft 30.

Also located in the flag holder block 166 orthogonally to the irregular aperture 168 is a cylindrical aperture 176, which extends through the flag holder block 166. Located in the bottom of the flag holder block 166 are two threaded apertures 178 and 180, which are in communication with the interior of the cylindrical aperture 176. Two thumbscrews 182 and 184 are screwed partially into the two threaded apertures 178 and 180, respectively.

The proximal end of a flag pole 186 is inserted into the cylindrical aperture 176 in the flag holder block 166, as shown. The two thumbscrews 182 and 184 are then tightened to hold the proximal end of the flag pole 186 in place. A flag 188 is located at the distal end of the flag pole 186. In this manner, the flag pole 186 and the flag 188 are mounted onto the apparatus illustrated in FIGS. 8 and 9.

Figure 11:
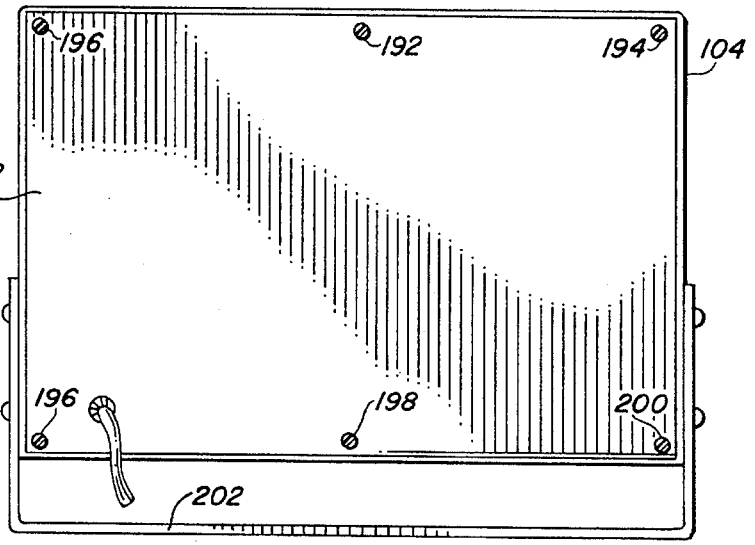
FIG. 11 is a side view of the enclosure illustrated in FIGS. 8 and 9, showing the cover plate illustrated in FIG. 10 mounted onto the open side of the enclosure to close the open side thereof, and also showing a mounting bracket used to mount the enclosure onto a support surface.

Referring now to FIG. 11, the cover plate 152 is placed on the open side of the enclosure 104, and is secured with six flat-head screws. A flat-head screw 190 is inserted into the countersunk aperture 154 in the cover plate 152, and then into the threaded aperture 124 in the enclosure 104. A flat-head screw 192 is inserted into the countersunk aperture 156 in the cover plate 152, and then into the threaded aperture 126 in the enclosure 104. A flat-head screw 194 is inserted into the countersunk aperture 158 in the cover plate 152, and then into the threaded aperture 128 in the enclosure 104.

A flat-head screw 196 is inserted into the countersunk aperture 160 in the cover plate 152, and then into the threaded aperture 130 in the enclosure 104. A flat-head screw 198 is inserted into the countersunk aperture 162 in the cover plate 152, and then into the threaded aperture 132 in the enclosure 104. A flat-head screw 200 is inserted into the countersunk aperture 164 in the cover plate 152, and then into the threaded aperture 134 in the enclosure 104.

A mounting bracket 202 may be attached to the enclosure 104 to facilitate mounting the entire apparatus on a boat (not yet shown and to be discussed below). The various wires leading out of the enclosure 104 through the aperture 165 (FIG. 10) are also illustrated in FIG. 11.

Figure 13:
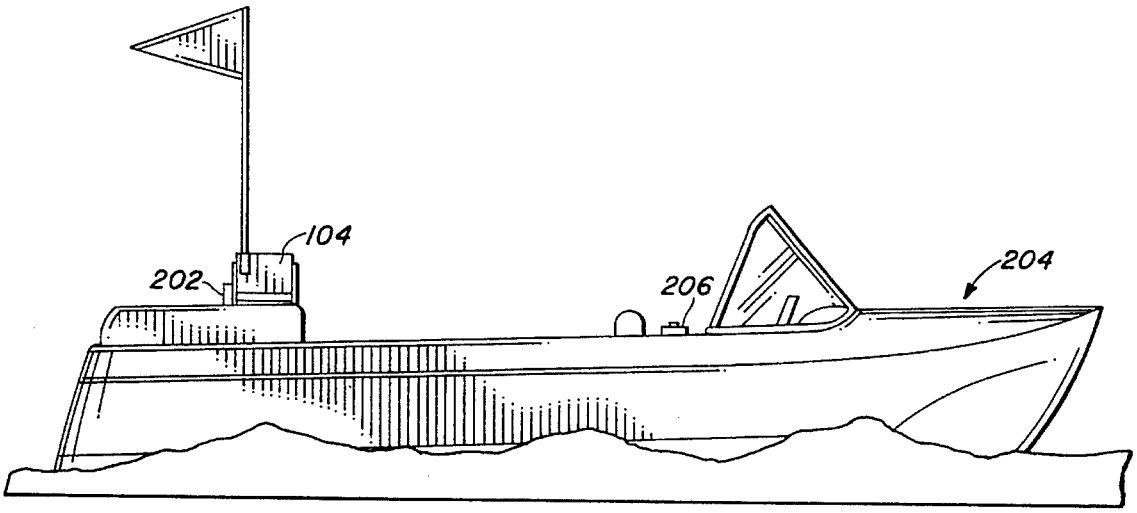
FIG. 13 is a somewhat schematic side view of a boat having the assembly illustrated in FIG. 11 together with the flag pole and the flag mounted onto the boat, and also showing a switch mounted on the boat for use by the operator of the boat or by an observer in the boat to operate the signaling device of the present invention.

Referring next to FIG. 13, a boat 204 is illustrated, with the mounting bracket 202 being used to mount the enclosure 104 and its contents onto the boat 204. A switch 206 is illustrated mounted on the boat 204, which switch 206 may be used by the operator of the boat or by an observer in the boat to operate the signaling device of the present invention.

Figure 14:
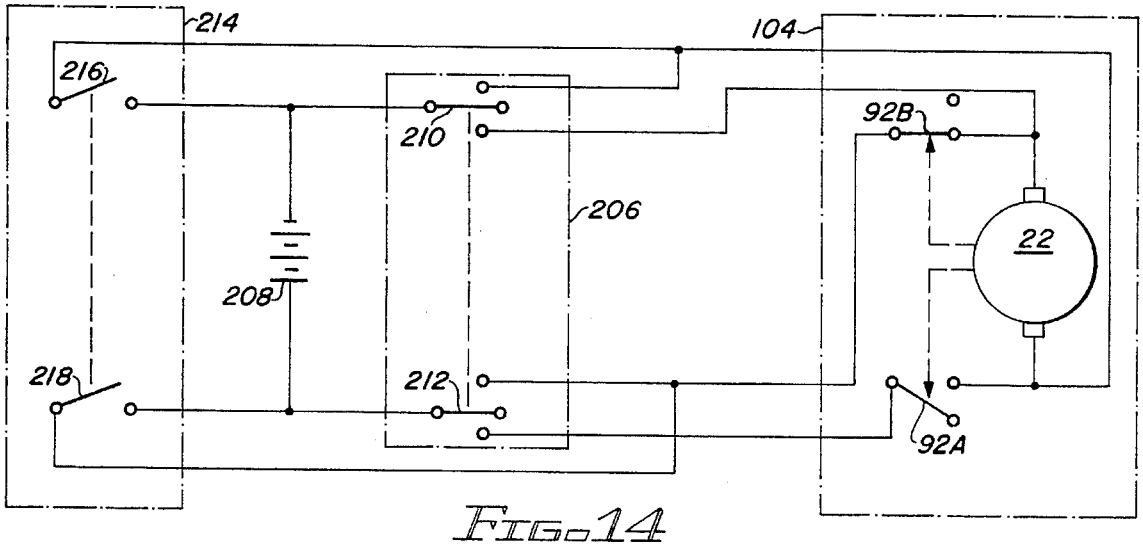
FIG. 14 is an electrical schematic of a circuit which may be used to operate the signaling device of the present invention, with the DC motor, the micro switches, and the boat-mounted switch being shown, and also showing a switch for placement into the handle of a water ski tow rope.

Referring next to FIG. 14, an electrical schematic of the present invention is illustrated which shows a number of the components discussed above, including the DC motor 22, the micro switches 92A and 92B, and the switch 206. An electrical power source 208, typically the battery of the boat 204, is used to supply power to the system. The switch 206, as mentioned above, is preferably a double-pole, double-throw (DPDT) on-off-on switch.

The switch 206 thus includes a first switch 210 and a second switch 212, which are mechanically linked to operate together. The common terminal of the first switch 210 is connected to the negative side of the electrical power source 208. The common terminal of the second switch 212 is connected to the positive terminal of the electrical power source 208. In the position shown in FIG. 14, both the first switch 210 and the second switch 212 are in their intermediate positions, in which they are unconnected to anything other than the electrical power source 208.

When the switch 206 is actuated in a first position, the first switch 210 will be connected to a first side of the DC motor 22. When the switch 206 is actuated in a second position, the first switch 210 will be connected to a second side of the DC motor 22. Similarly, when the switch 206 is actuated in the first position, the second switch 212 will be connected to one side of the micro switch 92B, the other side of which is connected to the second side of the DC motor 22. When the switch 206 is actuated in the second position, the second switch 212 will be connected to one side of the micro switch 92A, the other side of which is connected to the first side of the DC motor 22.

Thus, when the switch 206 is actuated in the first position, the DC motor 22 will be driven in a first direction if the micro switch 92B is closed, for as long as the micro switch 92B remains closed. Similarly, when the switch 206 is actuated in the second position, the DC motor 22 will be driven in a second direction (opposite to the first direction) if the micro switch 92A is closed, for as long as the micro switch 92A remains closed.

Referring now to FIG. 9 in addition to FIG. 14, it may be seen that the micro switches 92A and 92B are used to limit the travel of the output shaft 30 to a ninety degree range. The positions of the micro switches 92A and 92B in FIGS. 9 and 14 are identical. Thus, when the switch 206 is actuated in the first position, the motor 22 will be actuated, and will tend to drive the output shaft 30 in a clockwise direction as seen in FIG. 9. The micro switch 92B will remain closed until the output shaft 30 rotates ninety degrees clockwise, placing the pin 90 of the switch reverse block 78 into contact with the switch arm 94B, opening the micro switch 92B and stopping the motor 22.

From this position (which is not illustrated in the figures), if the switch 206 is actuated in the second position, the motor 22 will be actuated in the opposite direction through the micro switch 92A, and will tend to drive the output shaft 30 in a counter-clockwise direction as seen in FIG. 9. Thus, the micro switch 92A will remain closed until the output shaft 30 rotates ninety degrees counter-clockwise, placing the pin 90 of the switch reverse block 78 into contact with the switch arm 94A, opening the micro switch 92A and stopping the motor 22.

Thus, it will be appreciated by those skilled in the art that the DC motor 22 may be operated by the switch 206 to cause the output shaft 30 to rotate through ninety degrees upon command. With the flag pole 186 attached to the output shaft 30, the flag pole 186 will also rotate ninety degrees. Thus, actuating the switch 206 in the first position will cause the flag pole 186 to be driven to raise the flag 188, while actuating the switch 206 in the second position will cause the flag pole 186 to be driven to lower the flag 188.

The addition of one or more additional switches controlled by one or more water skiers completes the circuitry illustrated in FIG. 14. One (or more) double-pole, single-throw (DPST) switch(es) 214 is (are) provided to perform this function. The switch 214 contains a first switch 216 and a second switch 218, which are spring biased toward a closed position.

The switch 216 is connected between the negative side of the electrical power source 208 and the second side of the DC motor 22, while the second switch 218 is connected between the positive side of the electrical power source 208 and the one side of the micro switch 92B. Thus, when the switches 216 and 218 are in the closed position, they will tend to cause the DC motor 22 to raise the flag 188. When gripped, both the first switch 216 and the second switch 218 are opened. Thus, when released, the switch 214 will cause the flag 188 to be raised.

Figure 15:
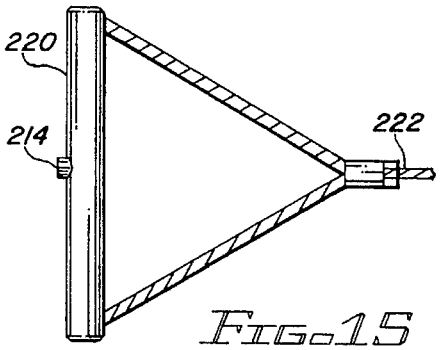
FIG. 15 is a plan view of a first possible arrangement for a tow rope handle containing a switch therein.
Figure 16:
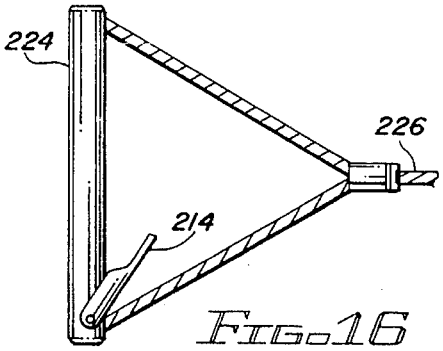
FIG. 16 is a plan view of a second possible arrangement for a tow rope handle containing a switch therein.

FIGS. 15 and 16 illustrate two embodiments of the implementation of the switch 214 into a handle for a water ski tow rope. In FIG. 15, the switch 214 is a button-type switch located in a handle 220, which is attached to a tow rope 222. In FIG. 16, the switch 214 is a lever-type switch located in a handle 224, which is connected to a tow rope 226. Connecting wires would run with either of the tow ropes 222 or 226.

As an additional alternate embodiment, it should be noted that the switch 206 could in its entirety be located in the handle of a water ski tow rope. In this case, whenever the handle was gripped, the switch 206 would be driven to its second position, causing the flag to be lowered. Thus, whenever the handle was released, the switch 206 would be driven to its first position, causing the flag to be raised.

It may therefore be appreciated from the above detailed description of the preferred embodiment of the present invention that it teaches a signaling device which is capable of operating positively and dependably without requiring as a basis for its operation the existence of a lack of tension in the tow rope. As such, the signaling device of the present invention is entirely capable of operation to deploy a flag quickly and automatically when a skier falls, yet in a manner which does not preclude manual actuation by the operator of the ski boat or by an observer in the boat. The signaling device of the present invention thus includes apparatus allowing for manual actuation of the device by the operator of the boat or by an observer in the boat to deploy the flag in emergency situations, in addition to its automatic actuation capability.

The signaling device of the present invention is usable with a boat towing a plurality of water skiers, and is operable to automatically raise the flag when any one of the water skiers is down in the water. The mechanism used by the signaling device of the present invention to raise the flag is highly compact in size, unlike past purely mechanical designs, while presenting a character of operation which is better than such past mechanical designs. In addition, the signaling device of the present invention is capable of installation on any boat in an easy and expeditious manner, without requiring the assistance of a professional.

The signaling device of the present invention is also of a construction which is both durable and long lasting, and it thus requires little or no maintenance to be provided by the user throughout its operating lifetime. In order to enhance the market appeal of the signaling device of the present invention, it is of inexpensive construction. Finally, all of the aforesaid advantages and objectives of the signaling device of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A warning device for use on a ski boat to indicate the presence of a downed water skier in the water, said ski boat containing an electrical power source, said warning device comprising:

electrically powered drive means for rotating an output shaft in a first direction when electrical power of a first polarity is supplied to said electrically powered drive means, and in a second direction when electrical power of a second polarity is supplied to said electrically powered drive means;

a first limit switch, said first limit switch being normally closed and opening only when actuated;

a second limit switch, said second limit switch being normally closed and opening only when actuated;

first switch means for location in the ski boat, said first switch means for alternately, selectively: a. supplying power from the ski boat's electrical power source through said first limit switch to said electrically powered drive means in said first polarity; or b. supplying power from said ski boat's electrical power source through said second limit switch to said electrically powered drive means in said second polarity; or c. not supplying power from said ski boat's electrical power source to said electrically powered drive means;

second switch means for location remote from the ski boat, said second switch means for alternately, selectively: a. supplying power from the ski boat's electrical power source through said first limit switch to said electrically powered drive means in said first polarity; or b. not supplying power from said ski boat's electrical power source to said electrically powered drive means;

an eccentric element fixedly mounted on said output shaft to rotate with said output shaft, said eccentric element having an actuating element extending therefrom, said actuating element functioning to alternately actuate said first limit switch and said second limit switch, said actuating element actuating said first limit switch when said output shaft reaches a first angular position, and said actuating element actuating said second limit switch when said output shaft reaches a second angular position; and flag means for providing a warning when raised, said flag means being mounted on said output shaft, said flag means being deployed when output shaft reaches said first angular position, and said flag means being undeployed when said output shaft reaches said second angular position.

2. A warning device as defined in claim 1, wherein said electrically powered drive means comprises:

a DC motor which rotates in a third direction when connected to electrical power with said first polarity, and in a fourth direction when connected to electrical power with said second polarity; and a gear reducer driven by said DC motor, said gear reducer driving said output shaft in said first direction when said DC motor rotates in said third direction, and said gear reducer driving said output shaft in said second direction when said DC motor rotates in said fourth direction.

3. A warning device as defined in claim 1, wherein said first switch means comprises:

a double-pole, double-throw switch.

4. A warning device as defined in claim 1, wherein said second switch means comprises:

a first single pole, single throw switch, said first single pole, single throw switch being in series between one side of the ski boat's electrical power source and one side of said electrically powered drive means; and a second single pole, single throw switch between the other side of the ski boat's electrical power source and the other side of said electrically powered drive means.

5. A warning device as defined in claim 1, additionally comprising:

a tow rope having a handle attached thereto, said handle having said second switch means mounted therein, said second switch means supplying power from the ski boat's electrical power source through said first limit switch to said electrically powered drive means in said first polarity whenever said handle is not being gripped, and said second switch means not supplying power from said ski boat's electrical power source to said electrically powered drive means whenever said handle is being gripped.

6. A warning device as defined in claim 1, wherein said first limit switch and said second limit switch each comprise:

a micro switch having an arm extending therefrom, said micro switch being normally closed, said micro switch being actuated causing it to open only when said arm of said micro switch is engaged and depressed.

7. A warning device as defined in claim 1, additionally comprising:

a mounting plate mounted adjacent a side of said electrically powered drive means, wherein said first limit switch and said second limit switch are mounted on said mounting plate.

8. A warning device as defined in claim 1, additionally comprising:

an enclosure in which said electrically powered drive means, said first limit switch, said second limit switch, and said eccentric element and said actuating element are located, wherein an end of said output shaft extends out of said enclosure.

9. A warning device as defined in claim 8, additionally comprising:

a bracket for installation onto a mounting surface in the ski boat, said bracket for holding said enclosure in a fixed position.

10. A warning device as defined in claim 1, wherein said first angular position of said output shaft and said second angular position of said output shaft are approximately ninety degrees apart.

11. A warning device as defined in claim 1, wherein said flag means comprises:

a flag holder block fixedly mounted on said output shaft to rotate therewith, said flag holder block having a flag mounting aperture therethrough, said flag mounting aperture being relatively vertical when said output shaft is in said first angular position, and said flag mounting aperture being relatively horizontal when said output shaft is in said second angular position;

a flag pole having a proximal end and a distal end, said proximal end of said flag pole for placement into said flag mounting aperture in said flag holder block; and a flag disposed at said distal end of said flag pole.

12. A warning device as defined in claim 11, additionally comprising:

means for releasably retaining said flag pole in said flag mounting aperture in said flag holder block.

13. A warning device for use on a ski boat to indicate the presence of a downed water skier in the water, said ski boat containing an electrical power source, said warning device comprising:

electrically powered drive means for rotating an output shaft in a first direction when electrical power of a first polarity is supplied to said electrically powered drive means, and in a second direction when electrical power of a second polarity is supplied to said electrically powered drive means;

a first limit switch, said first limit switch being normally closed and opening only when actuated;

a second limit switch, said second limit switch being normally closed and opening only when actuated;

first switch means for location in the ski boat, said first switch means for alternately, selectively: a. supplying power from the ski boat's electrical power source through said first limit switch to said electrically powered drive means in said first polarity; b. supplying power from said ski boat's electrical power source through said second limit switch to said electrically powered drive means in said second polarity; or c. not supplying power from said ski boat's electrical power source to said electrically powered drive means;

second switch means located in a handle remote from the ski boat and connected to the ski boat by a tow rope, said second switch means for alternately, selectively: a. supplying power from the ski boat's electrical power source through said first limit switch to said electrically powered drive means in said first polarity; or b. not supplying power from said ski boat's electrical power source to said electrically powered drive means;

an eccentric element fixedly mounted on said output shaft to rotate with said output shaft, said eccentric element having an actuating element extending therefrom, said actuating element functioning to alternately actuate said first limit switch and said second limit switch, said actuating element actuating said first limit switch when said output shaft reaches a first angular position, and said actuating element actuating said second limit switch when said output shaft reaches a second angular position; and a flag for providing a warning when raised, said flag being disposed at the distal end of a flag pole mounted by its proximal end on said output shaft, said flag being deployed when said output shaft reaches said first angular position, and said flag being undeployed when said output shaft reaches said second angular position.

14. A method for providing a warning for use on a ski boat to indicate the presence of a downed water skier in the water, said ski boat containing an electrical power source, said method comprising:

with an electrically powered drive installed on the ski boat, rotating an output shaft in a first direction when electrical power of a first polarity is supplied to said electrically powered drive, and in a second direction when electrical power of a second polarity is supplied to said electrically powered drive;

alternately actuating a first limit switch and a second limit switch with an actuating element extending from an eccentric element, said eccentric element being fixedly mounted on said output shaft to rotate with said output shaft, said actuating element actuating said first limit switch when said output shaft reaches a first angular position, said first limit switch being normally closed and opening only when actuated, and said actuating element actuating said second limit switch when said output shaft reaches a second angular position, said second limit switch being normally closed and opening only when actuated;

with a first switch located in the ski boat, alternately, selectively: a. supplying power from the ski boat's electrical power source through said first limit switch to said electrically powered drive in said first polarity; b. supplying power from said ski boat's electrical power source through said second limit switch to said electrically powered drive in said second polarity; or c. not supplying power from said ski boat's electrical power source to said electrically powered drive;

with a second switch located remote from the ski boat, alternately, selectively: a. supplying power from the ski boat's electrical power source through said first limit switch to said electrically powered drive in said first polarity; or b. not supplying power from said ski boat's electrical power source to said electrically powered drive; and deploying a flag mounted on said output shaft when output shaft reaches said first angular position, said flag being undeployed when output shaft reaches said second angular position.

* * * * *